US009675948B2

(12) United States Patent
Fujiyama et al.

(10) Patent No.: US 9,675,948 B2
(45) Date of Patent: Jun. 13, 2017

(54) STIRRING DEVICE AND STIRRING METHOD

(71) Applicant: HONDA MOTOR CO., LTD., Minato-ku, Tokyo (JP)

(72) Inventors: Shinsuke Fujiyama, Tokyo (JP); Nagafumi Muta, Tokyo (JP); Youhei Shimokawa, Tokyo (JP); Toshikazu Shiojiri, Tokyo (JP); Masato Yokemura, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 130 days.

(21) Appl. No.: 14/391,575

(22) PCT Filed: Feb. 27, 2013

(86) PCT No.: PCT/JP2013/055125
§ 371 (c)(1),
(2) Date: Oct. 9, 2014

(87) PCT Pub. No.: WO2013/153862
PCT Pub. Date: Oct. 17, 2013

(65) Prior Publication Data

US 2015/0124555 A1 May 7, 2015

(30) Foreign Application Priority Data

Apr. 12, 2012 (JP) ..... 2012-090667

(51) Int. Cl.
*B01F 15/02* (2006.01)
*B01F 5/10* (2006.01)
(Continued)

(52) U.S. Cl.
CPC ..... *B01F 15/0261* (2013.01); *B01F 3/088* (2013.01); *B01F 5/10* (2013.01);
(Continued)

(58) Field of Classification Search
CPC ..... B01F 15/0261
(Continued)

(56) References Cited

U.S. PATENT DOCUMENTS 3,180,350 A * 4/1965 Rill et al. ..... B29B 7/404 137/240
6,457,852 B1 * 10/2002 Hiraoka ..... B01F 3/088 366/136
6,554,162 B2 4/2003 Schell et al.

FOREIGN PATENT DOCUMENTS

JP 47-24324 Y1 8/1972
JP 05-106181 A 4/1993
(Continued)

*Primary Examiner* — David Sorkin
(74) *Attorney, Agent, or Firm* — Carrier Blackman & Associates, P.C.; Joseph P. Carrier; Anne G. Sabourin

(57) ABSTRACT

When a first electromagnetic valve of a first stirring tank is turned ON and a second electromagnetic valve of a second stirring tank is turned OFF, the air pressure inside the first stirring tank increases and the liquid in the first stirring tank is sent into the second stirring tank via piping. When the volume of the liquid inside the second stirring tank reaches an upper limit, the first electromagnetic valve of the first stirring tank is turned OFF and the second electromagnetic valve of the second stirring tank is turned ON. As a result, the liquid inside the second stirring tank is now sent into the first stirring tank via the piping. Ultimately, because the liquid is circulated between the first and second stirring tanks and the liquid is flowing at all times due to the repetition of said actions, separation does not occur.

2 Claims, 2 Drawing Sheets

(51) Int. Cl.

| | |
|---|---|
| ***B01F 13/08*** | (2006.01) |
| ***B01F 15/00*** | (2006.01) |
| ***B01F 3/08*** | (2006.01) |
| *B01F 3/00* | (2006.01) |

(52) U.S. Cl.
CPC ..... *B01F 13/08* (2013.01); *B01F 13/0818* (2013.01); *B01F 15/00155* (2013.01); *B01F 2003/0035* (2013.01)

(58) Field of Classification Search
USPC ..... 366/191, 274
See application file for complete search history.

(56) References Cited

FOREIGN PATENT DOCUMENTS

| | | | |
|---|---|---|---|
| JP | 09-067547 | A | 3/1997 |
| JP | 2003-062442 | A | 3/2003 |
| JP | 2007-069436 | A | 3/2007 |
| JP | 2009-189925 | A | 8/2009 |
| JP | 2011-026982 | A | 2/2011 |

* cited by examiner

STIRRING DEVICE AND STIRRING METHOD

FIELD OF THE INVENTION

The present invention is related to a stirring device and a stirring method for a liquid in which the ingredients separate when it is left at rest, for example, release agents for a die.

BACKGROUND ART

The main component of the die release agent is silica and aluminum oxide (alumina), these are hard to dissolve in water.

Thus, to prevent them from separating, it is necessary to continually stir them in the stirring tank.

Patent document 1 discloses a device to force-feed a liquid while stirring. In this device, a stirring tank (airtight container) is placed on a stirrer, a pipe to feed dry air into the stirring tank and a pipe to take out the liquid from the stirring tank are attached to the cover portion of the stirring tank.

Patent document 2 discloses a device comprising two containers, which is not a device for stirring a liquid, in this device, a first component and a second component which together form an adhesive are retained in each container, and the two components are mixed and discharged with an adhesive coating gun.

PRIOR ART

Patent Document

[Patent Document 1] Japanese Laid Open Patent 2007-69436

[Patent Document 2] Japanese Laid Open Patent H09-67547

DISCLOSURE OF INVENTION

Problems Solved by the Invention

In the stirring device disclosed in Patent Document 1, a liquid from one stirring tank is force-fed through the pipe comprising the pump, and the pump is stopped when the liquid is not being force-fed.

In this condition the liquid which remains lying in the pipe separates, even if it is being continuously stirred in the stirring tank.

Also, though two containers are used in Patent Document 2, the first component and the second component are mixed inside of the nozzle, even if this technique is applied, the mixed condition of a liquid in which the release agents are easily separated cannot be maintained.

Means for Solving Problems

To solve the above described problem, a stirring device of the present invention comprises;

- a pair of stirring tanks,
- a stirrer which stirs the liquid in the stirring tanks,
- an air supplying member which force-feeds air into each stirring tank,
- an output-input member which can send the liquid in the stirring tank to the outside by air pressure and can also accept a liquid from the outside
- a pipe which connects the output-input member of each stirring tank,
- and a flow path switch valve which is provided in the middle of the pipe for supplying a liquid to the point of use, such as nozzles.

It is preferable to have a cover for the stirring tank, and the air supplying member and the output-input member are attached to the cover, the sensors measuring the surface height in the stirring tank are attached at the center and at a point between the center and the outer edge of the cover, and the stirring condition is determined from the measurements of these sensors.

It is preferable to provide the flow path switch valve right in front of the point of use of the liquids, such as nozzles.

By providing the flow path switch valve at a position as near as possible to the nozzle, the length of pipe in which liquid is retained, and can therefore separate while the flow is dormant, is shortened.

Also, a stirring bar which is made to rotate is provided by the stirrer in each stirring tank, two levels of protective members attached, in such a way as to be changeable, on the internal base of the stirring tank may be provided, the stirring bar rotates on the internal base.

A stainless steel board or a thin stainless steel sheet is considered as the protective member.

By providing two levels of protective members in this way, they can be easily changed when the protective member is worn by the rotation of the stirring bar.

Also, the stirring method of the present invention has the following structure:

Prepare a pair of stirring tanks provided with an output-input member, a liquid in the stirring tank is stirred by a stirrer, each liquid in the stirring tank is discharged by air pressure, connect the output-input member of the stirring tank with a pipe, provide a flow path switch valve supplying a liquid to the point of use of the liquids such as nozzles in the middle of the pipe, move the liquid between the stirring tanks through the flow path switch valve when the liquid is not being applied, send the liquid in one stirring tank to the point of use of the liquids such as nozzles by changing the flow path switch valve when the liquid is being applied.

Effects of the Invention

According to the present invention, even in the case where a liquid in which the release agents are easily separated is being used, the liquid is not separated, not only in the stirring tank but also in the pipes which extend from the stirring tank to the points of use, such as nozzles.

Accordingly, right from the start of use, liquid which is in a separated state can be prevented from discharging.

BEST MODE FOR CARRYING OUT THE INVENTION

Figure 1:
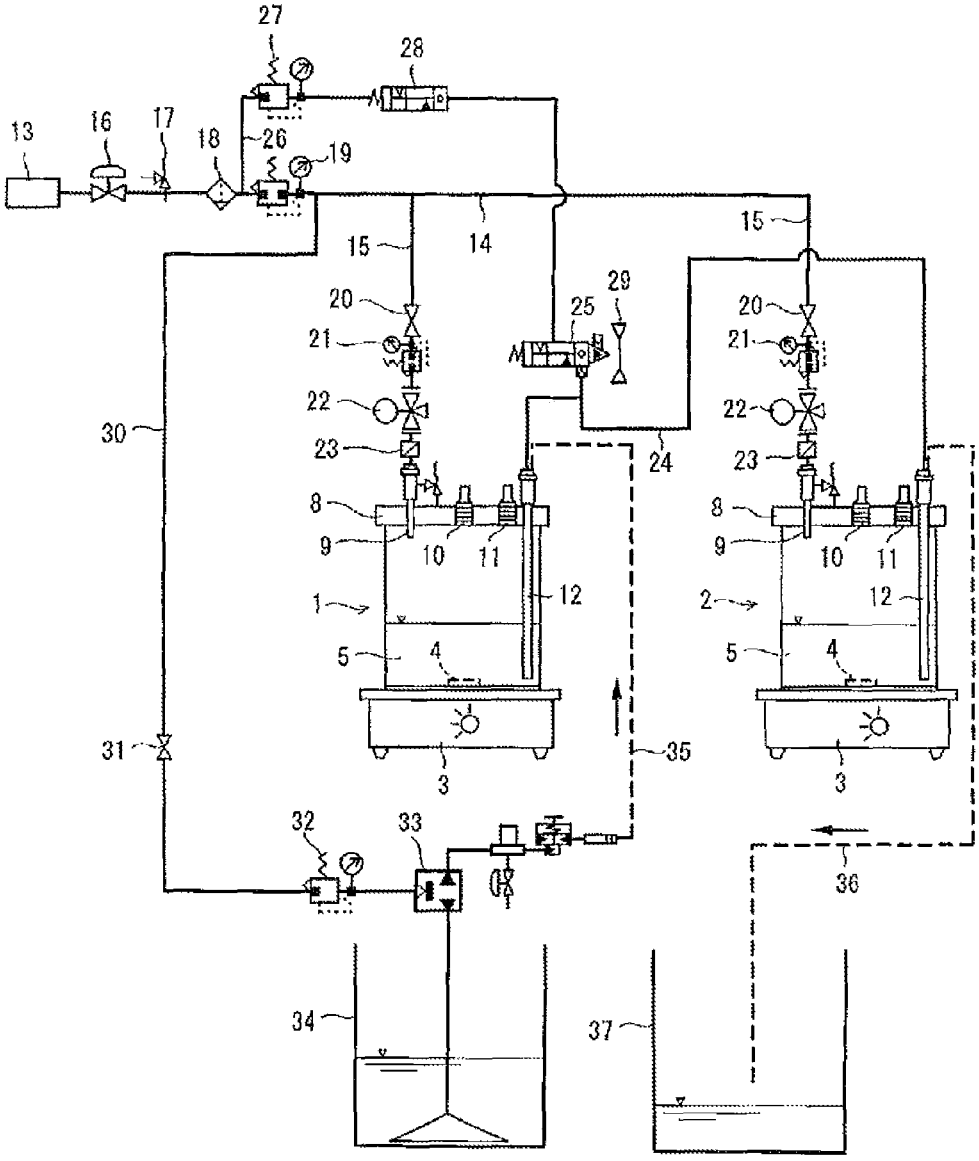
FIG. 1 A figure of the whole structure of the stirring device of the present invention FIG. 2 A figure explaining an operation of the stirring tank of the stirring device FIG. 3 An enlarged view of the bottom of a stirring tank of the stirring device

An embodiment of the present invention is explained below based on the attached drawings. A stirring device of the present invention comprises one pair of stirring tanks 1, 2. Each stirring tank 1, 2 is put on a magnetic stirrer 3, a stick-like stirring bar 4 installed in the bottom of the stirring tank 1, 2 is rotated by the magnetic stirrer 3, and a liquid 5 in the stirring tank 1, 2 is stirred.

Figure 3:
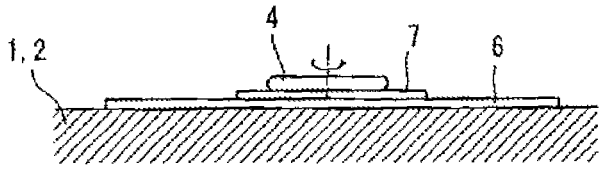

As shown in FIG. 3, as a protective member, two sheets of a stainless steel board 6, 7 are mounted, one on top of the other, on the base of the stirring tank 1, 2 where the stirring bar 4 rotates, the upper stainless steel board 7 is attached using an adhesive which can be detached, such that it can easily be exchanged.

Each stirring tank 1, 2 comprise a cover 8, a pipe-shaped air supply member 9, ultrasonic sensors 10, 11 and a pipe-shaped output-input member 12 attached to the cover 8.

Air from a compressed air source 13 is supplied to an air supply member 9 on each stirring tank 1, 2 through a main pipe 14 and a branch pipe 15.

The main pipe 14 is provided with a ball valve 16, a residual pressure removal member 17, a filter 18 and a regulator 19 placed in this order from an upstream direction.

Similarly, the branch pipe 15 is provided with a ball valve 20, a regulator 21, an electromagnetic valve 22 and relief valve 23, placed in this order from an upstream direction.

The ultrasonic sensors 10, 11 measure the surface height of the liquid 5, ultrasonic sensor 10 is attached to the center of the cover 8, ultrasonic sensor 11 is attached offset from the center nearer the circumference of the cover 8.

Figure 2:
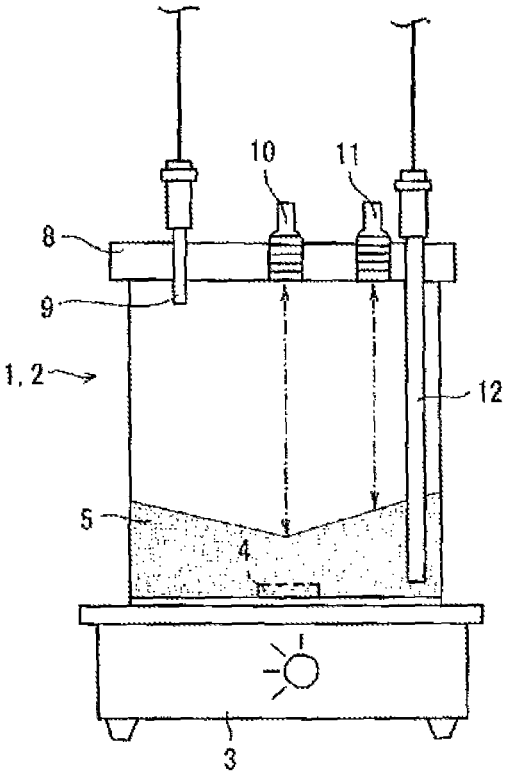

When the magnetic stirrer 3 is driven and turns the rotor, the liquid 5 is turned. As shown in FIG. 2, when the liquid turns, it forms a whirlpool in which the center is low and the outside is high, and when the rotational velocity speeds up, the angle of inclination of the surface of the liquid increases.

Thus, the angle of inclination of the surface is detected from the surface height readings of the center and the outer periphery of the liquid 5 taken by the ultrasonic sensors 10, 11, thereby, determining whether the stirring state of the liquid 5 is sufficient, and the drive of the magnetic stirrer 3 is adjusted intermittently by feedback control to vary the rotational velocity of the rotor 4.

Note that, a judgment is made as to whether a predetermined quantity of the liquid 5 is left in the stirring tank 1, 2.

The output-input member 12 sends the liquid 5 in stirring tanks 1, 2 outside by air pressure, and the output-input member 12 receives the liquid 5 from the outside, the output-input members 12 of stirring tanks 1, 2 are connected by a pipe 24, moreover, a nozzle 25 discharging a liquid is provided in the middle of the pipe 24.

The nozzle 25 is switched on/off by air from the compressed air source 13. That is, a branch pipe 26 diverges from the downstream location of the filter 18 of the main pipe 14, the branch pipe 26 is provided with a regulator 27 and a switch 28, when a worker turns on the switch 28, air pressure is sent to the nozzle 25, and the liquid 5 is sent into the nozzle 25 through the pipe 24.

Also, a photoelectric sensor 29 is located before the nozzle 25.

In assuming the construction, it can be judged as to whether a liquid discharges from the nozzle 25 when switch 28 is turned on.

Also, another branch pipe 30 diverges from the downstream location of the regulator 19 of the main pipe 14, the branch pipe 30 is provided with a ball valve 31 and a regulator 32, the tip of the branch pipe 30 leads to a washing pump 33 driven by air pressure, and by the drive of the washing pump 33, the washing water in a washing water tank 34 is sent into the stirring tank 1 from a pipe 35 through the output-input member 12.

Note that to avoid complexity, only washing water being sent into stirring tank 1 is shown in the illustration example. However, pipe 35 also leads to the output-input member 12 of the other stirring tank 2, so that both of the stirring tanks 1, 2 can be washed when it is necessary, for example, before or after use of the liquid 5.

Also, a drain pipe 36 is derived from the output-input member 12 of stirring tank 2, extra liquid 5 is discarded to a drain tank 37 through the drain pipe 36. Though the illustration is omitted, similar to the above, stirring tank 1 is provided with a drain pipe 36.

In the above, when the switch 28 is turned on, a liquid is discharged from the nozzle 25, and when the switch 28 is turned off, in other words, when a liquid is not discharged from the nozzle 25, a liquid is sent from one of the stirring tanks 1, 2 into the other, so that liquid does not stay in the pipe 24.

That is, for example, when the electromagnetic valve 22 of a stirring tank 1 is turned ON and the electromagnetic valve 22 of stirring tank 2 is turned OFF, the air pressure inside stirring tank 1 increases and the liquid 5 in stirring tank 1 is sent into stirring tank 2 via the piping 24.

When the volume of the liquid 5 inside stirring tank 2 reaches an upper limit, the electromagnetic valve 22 of stirring tank 1 is turned OFF and the electromagnetic valve 22 of stirring tank 2 is turned ON.

As a result, the liquid 5 inside the stirring tank 2 is now sent into the stirring tank 1 via the piping 24. Ultimately, because the liquid 5 is circulated between the stirring tanks (1 and 2), and the liquid is flowing at all times due to the repetition of said actions, separation does not occur.

INDUSTRIAL APPLICABILITY

The stirring method of the present invention is available to stir the liquid which is easy to separate as well as the release agent of the die.

EXPLANATIONS OF THE LETTERS AND NUMERALS

1,2 . . . stirring tank, 3 . . . magnetic stirrer, 4 . . . stirring bar, 5 . . . liquid, 6,7 . . . stainless steel board, 8 . . . cover, 9 . . . compressed air source, 10,11 . . . ultrasonic sensor, 12 . . . output-input member, 13 . . . compressed air source, 14 . . . main pipe, 15 . . . branch pipe, 16 . . . ball valve, 17 . . . residual pressure removal member, 18 . . . filter, 19 . . . regulator, 20 . . . ball valve, 21 . . . regulator, 22 . . . electromagnetic valve, 23 . . . relief valve, 24 . . . pipe, 25 . . . nozzle, 26 . . . branch pipe, 27 . . . regulator, 28 . . . switch, 29 . . . photoelectric sensor, 30 . . . branch pipe, 31 . . . ball valve, 32 . . . regulator, 33 . . . washing pump, 34 . . . washing water tank, 35 . . . pipe, 36 . . . drain pipe, 37 . . . drain tank.

The invention claimed is:

1. A stirring method comprising the steps of:

preparing a pair of stirring tanks, each tank being provided with an output-input member, stirring a liquid inside the stirring tanks by a stirrer, and each liquid in the stirring tanks is sent out by air pressure, connecting the output-input members of the stirring tanks with a pipe, providing a switch for controlling supply of a liquid to nozzles located in the pipe, controlling flow of the liquid between the stirring tanks by the switch so that when the switch is off a liquid is not being applied, and the liquid in one stirring tank is sent to the other stirring tank, and when the switch is on, the liquid in the one stirring tank is sent to the nozzles, wherein the liquid is circulated between the stirring tanks, and some of the liquid is flowing at all times.

2. The stirring method of claim 1, wherein the pair of stirring tanks each further comprises an electromagnetic valve, wherein in a first step when the electromagnetic valve in the one stirring tank is turned on, the electromagnetic valve in the other stirring tank is turned off, and air pressure in the one stirring tank increases and liquid in the one stirring tank is sent into the other stirring tank via the pipe connecting the output-input members of each pipe; and wherein in a second step, when the volume of liquid in the other stirring tank reaches an upper limit, the electromagnetic valve of the one stirring tank is turned off and the electromagnetic valve of the other stirring tank is turned on, and, as a result, liquid is sent into the one stirring tank, thereby circulating the liquid between the one and the other stirring tanks, and some of the liquid is flowing at all times due to the repetition of these steps.

* * * * *